US005658065A

United States Patent [19]

Jamieson

[11] Patent Number: 5,658,065

[45] Date of Patent: Aug. 19, 1997

[54] FLASHLIGHT HOLDER FOR PROTECTIVE HELMETS, HARDHATS OR THE LIKE

[76] Inventor: Jim Jamieson, 4425 Mayfair, Montreal, Que., Canada, H4B 2E2

[21] Appl. No.: 249,040

[22] Filed: Mar. 25, 1994

Related U.S. Application Data

[63] Continuation-in-part of Ser. No. 29,392, Mar. 10, 1993, abandoned.

[51] Int. Cl.[6] ..... F21L 15/14

[52] U.S. Cl. ..... 362/106; 362/191; 2/6.2; 2/422; 224/181

[58] Field of Search ..... 362/103, 105, 362/106, 190, 191, 197, 199, 421, 427; 2/6.2, 422; 224/181

[56] References Cited

U.S. PATENT DOCUMENTS

| | | | |
|---|---|---|---|
| 608,109 | 7/1898 | Dow | 362/105 |
| 2,421,643 | 6/1947 | Ostli | 362/106 |
| 3,133,705 | 5/1964 | Eickelman | 362/106 |
| 3,550,824 | 12/1970 | Bohanski | 362/103 |
| 3,864,756 | 2/1975 | Desimone | 2/6.2 |
| 4,090,232 | 5/1978 | Golden | 362/106 |
| 4,516,192 | 5/1985 | Bolwig | 362/107 |
| 4,521,831 | 6/1985 | Thayer | 362/106 |
| 4,793,007 | 12/1988 | Barnett | 362/106 |
| 4,998,187 | 3/1991 | Herrick | 362/105 |
| 5,103,384 | 4/1992 | Drohan | 362/421 |

FOREIGN PATENT DOCUMENTS

| | | |
|---|---|---|
| 1093523 | 1/1981 | Canada . |

*Primary Examiner*—Alan Cariaso
*Attorney, Agent, or Firm*—Mila Shvartsman

[57] ABSTRACT

The present invention is related to a flashlight holder for protective helmets, hardhats or the like comprising a carrier element adapted to accommodate within its inner walls a standard flashlight, an adjustment means connected to the carrier element and provided to adjust the carrier holding the flashlight in the position required by the protective helmet wearer. A mounting adaptor means is connected to the carrier element by the adjustment means and provided to releasably attach the holder to the protective helmet. The holder is attached to the side of the helmet and adjustment means are located at the lower extremity of the carrier element. Those adjustment mean comprises a swivel ball-socket arrangement. Another embodiment comprises a carrier integrally connected to an outer wall or casing of the flashlight element.

30 Claims, 9 Drawing Sheets

FLASHLIGHT HOLDER FOR PROTECTIVE HELMETS, HARDHATS OR THE LIKE

This application is a continuation-in-part of application Ser. No. 08/029,392, filed Mar. 10, 1993, now abandoned.

This application in part discloses and claims subject-matter disclosed in my earlier filed application Ser. No. 08/029,392 filed Mar. 10, 1993. This invention relates generally to safety equipment, and especially to a flashlight holder for protective helmets, hardhats and the like, which may be attached to the helmet by means of standard adaptors or by means of a specially designed separate adaptor.

Protective helmets used by workmen in various industries are usually adapted to carry various kinds of protective equipment, such as earmuffs, face shields and the like. To facilitate easy mounting and dismounting of such equipment, the helmet in the case of standard construction helmets is provided with slots on each side just above the ears of the wearer of the helmet. Other types of protective helmets require separate adaptors.

There is known Canadian patent 1,092,523 related to a battery case and lamp assembly detachably engaged with a pair of clips secured to the front of the helmet. A lower horizontal rod is attached to the back of the battery case which allows a lamp assembly to pivot around said rod by means of a plurality of projecting teeth.

There is also known U.S. Pat. No. 4,090,232 related to illuminating means for the head in which a light is permanently attached to a hat and adapted to be powered by one or more electric storage batteries mounted on the hat.

Furthermore there is known U.S. Pat. No. 4,516,192 for a lamp carriage arm, adapted for attachment to a safety hat. The lamp carriage arm attaches at one end to one side of the safety hat, and extends downwardly in a space relationship to the side of the safety hat wearer's head. Conventional lighting is carried at the other end of the lamp. A small counterweight is installed on the other side of the helmet.

Those and other known lamp assemblies are not adapted to carry a standard self-powered flashlight and need a separate battery case or an auxiliary source of electric power, which makes the entire assembly heavier, more expensive and more difficult in use.

The present invention is directed towards overcoming the above and other disadvantages of prior light assemblies.

SUMMARY OF THE INVENTION

The object of the present invention is a flashlight holder for protective helmets, hardhats or the like comprising:

a carrier element having outer walls and inner walls and adapted to accommodate within its inner walls a standard flashlight; wherein said carrier element accommodates said flashlight across the flashlight's width;

an adjustment means connected to said carrier element and provided to adjust said carrier holding the flashlight in any position desired by the protective helmet wearer;

a mounting adaptor means connected to said carrier element by said adjustment means and provided to releasably attach said holder to the protective helmet, wherein said holder is attached directly to a side of the helmet and wherein said mounting adaptor means is adapted to withstand an extensive abuse in a heavy industrial environment.

Another object of the present invention is a holder, wherein said holder is attached to the side of the helmet;

said adjustment means are located at the lower extremity of said carrier element, and said adjustment means comprises a swivel ball-socket arrangement.

Yet another object of the present invention is a holder, wherein the ball of said ball-socket arrangement is an integral part of said carrier element, wherein said socket is incorporated within the upper part of said adaptor means, and wherein said ball is secured in said socket by tightening means; said carrier is provided with a size adaptor, located within the inner walls of said carrier and provided to fit a flashlight of smaller size.

Still another object of the present invention is a holder, wherein said holder is made of a non-conductive material;

said adaptor means comprises:

an adaptor provided for mounting earmuffs and an intermediate adaptor provided to connect said adaptor to said adjustment means.

And yet another object of the present invention is a holder, wherein said carrier element having a securing means provided to secure the flashlight within said carrier; said adapter means comprises two vertically oriented halves, and wherein said socket is incorporated within the upper parts of said halves; said ball is secured in said socket by tightening means, and a holder, wherein said securing means comprises a resiliency of the inner wall of said carrier providing clamping action towards the flashlight accommodated inside of said carrier.

Still the other embodiment of the present invention comprises a combination of a protective helmet comprising a hat and a flashlight holder releasably attached to the side of said helmet, wherein said holder comprises:

a carrier element having outer walls and inner walls and adapted to accommodate within its inner walls a standard flashlight, wherein said carrier element accommodates said flashlight across the flashlight's width;

an adjustment means connected to said carrier element and provided to adjust a light of said flashlight under any desirable angle by the protective helmet wearer, a mounting adaptor means connected to said carrier element by said adjustment means and provided to releasably attach said holder to said protective helmet;

wherein said holder is attached directly to a side of the helmet and wherein said adaptor means is adapted to withstand an extensive abuse in a heavy industrial environment.

DESCRIPTION OF THE PREFERRED EMBODIMENT

Figure 1:
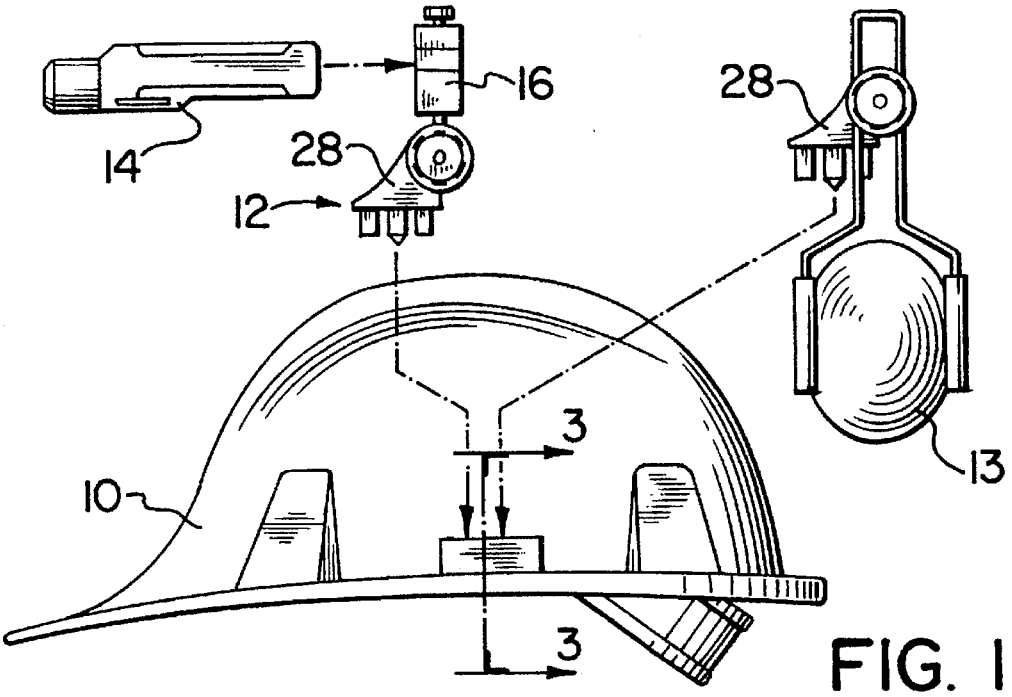
FIG. 1 shows a side view on the helmet according to the first embodiment of the present invention showing disassembled holder, flashlight and an earmuffs mounted on the holder.
Figure 2:
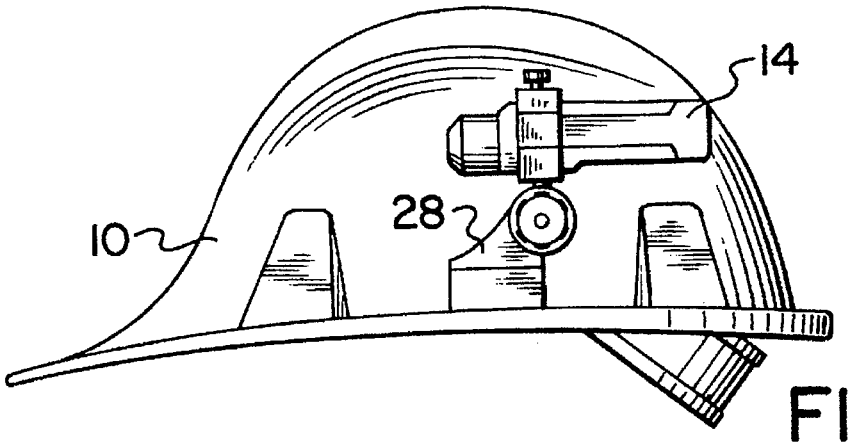
FIG. 2 shows a side elevational view of the flashlight holder of the present invention attached to a safety helmet.

Referring now to the drawings, the preferred embodiment of the present invention will be described. FIGS. 1–15 show the first embodiment of the invention. The holder 12 comprises a carrier element 16 provided at its lower extremity with a ball 18 which is part of an adjustment means provided to adjust the angle of the flashlight 14 accommodated within the inner wall of carrier 16. The second part of the adjustment means or socket 20 is incorporated within an upper part of an intermediate adaptor 22 which consists of two identical clamps 24 and 26. Said carrier element 16 together with intermediate adaptor 22 are secured to an adaptor 28 by means of bolt 34 and tension nut 36 of said adaptor. In this case carrier 16 is inserted between clamps 24 and 26 of an intermediate adaptor 22 after which pressure is applied to the ball 18 of carrier 16 by tightening the tension nut 36 against clamp 26. In turn the adaptor 28 is detachably mounted directly on the side of on a safety helmet 10 by means of a leaf 30 and resilient tong 32 into a slot provided on each side of the helmet 10. The shape of the inner walls of the carrier 16 is adapted to fit a standard self-powered flashlight and in the preferred embodiment has substantially an O-shape configuration as shown on FIG. 4.

However the shape of the inner walls is not restricted to said embodiment and may be modified according to the shape of future types of standard small flashlights. A thumb nut 17 may be used to secure the flashlight 14 inside carrier 16.

In order to fit a flashlight of smaller size, such as a penlight size flashlight, there is provided a size adaptor 21, which may be snapped inside of carrier 16. Preferably, but not necessarily, a ball 18 is located at the lowest extremity of carrier 16, wherein said ball 18 is an integral part of carrier 16. Said ball-socket arrangement permits adjustment of the carrier 16 to aim the flashlight beam to wherever light is required.

However, the present invention is not restricted to a ball-socket arrangement, thus any other adjustment means can be used for the same purpose. All parts of holder 12 are made from non-conductive plastic material by means of injection molding, wherein said material has the strength to withstand abuse in a heavy industrial environment; this is a definite advantage for those workers who face the possibility of contact with electrical apparatus. The adaptor 28 of the first embodiment is an adaptor which is manufactured by Mine Safety Appliances Company and may be also used in combination with earmuffs 13 (see FIG. 1), face shield or other equipment, mounted on the same side as the holder of the invention. Ball-socket arrangement of the present invention allows to rotate the holder with the attached flashlight in any direction. This, of course is very advantageous feature of the present invention.

Figure 3:
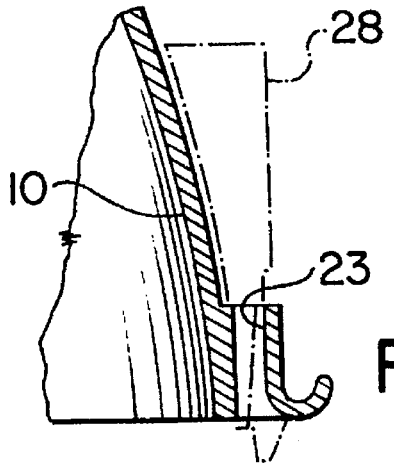
FIG. 3 shows a fragment of side cross-section taken along lines 3—3 showing a pre-fabricated slot for mounting the adapter.
Figure 4:
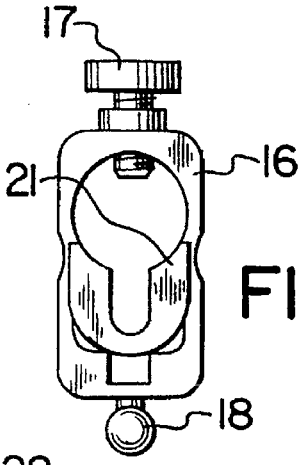
FIG. 4 is a front view of a carrier element of the holder.
Figure 5:
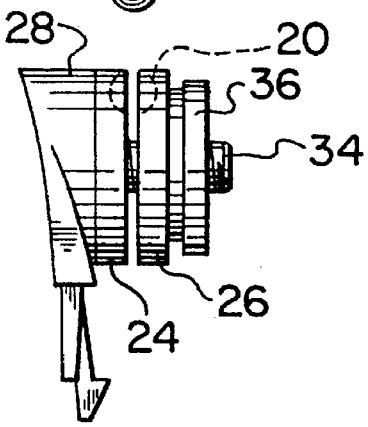
FIG. 5 is a side view of the assembly showing an earmuffs adaptor and intermediate adaptor.
Figure 6:
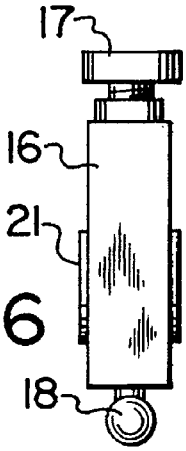
FIG. 6 shows a side view of the carrier of FIG. 4.
Figure 7:
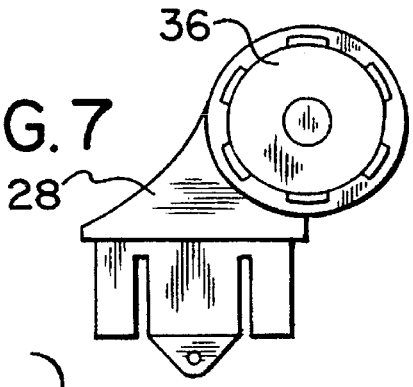
FIG. 7 shows a side view of the assembly of FIG. 5.
Figure 8:
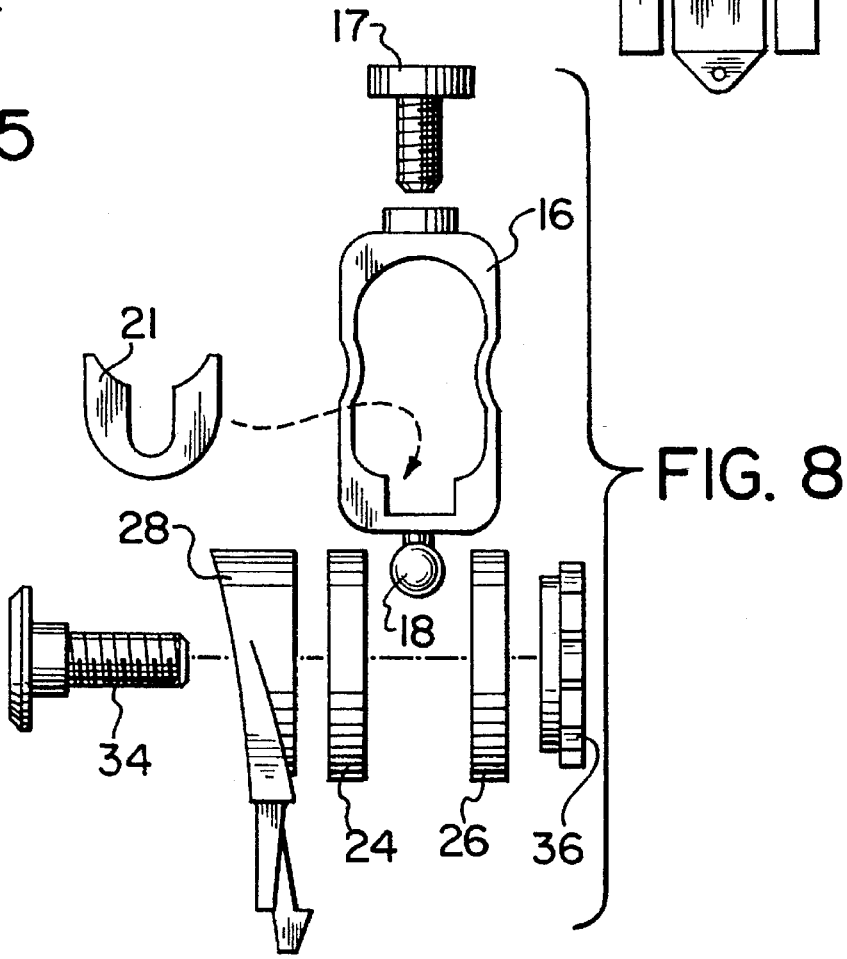
FIG. 8 shows a side view of the disassembled adaptors and carrier of FIGS. 4 and 5.
Figure 9:
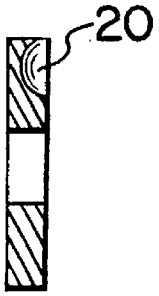
FIG. 9 shows a side view of the left portion of the intermediate adaptor taken along the lines 9—9 of FIG. 10.
Figure 10:
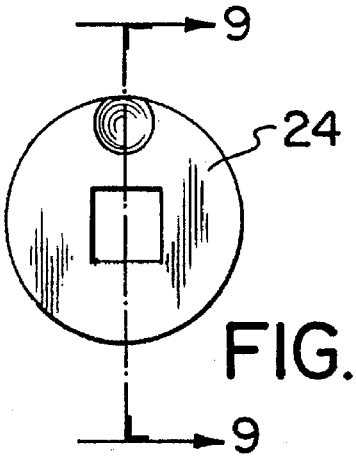
FIG. 10 shows a front view of FIG. 9.
Figure 11:
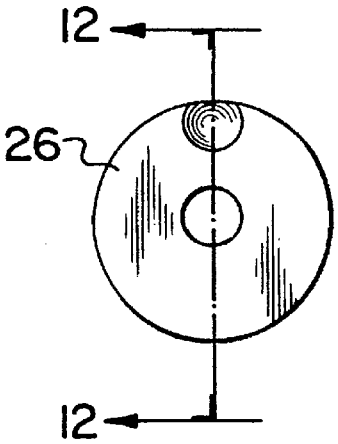
FIG. 11 shows a front view of the right portion of the intermediate adaptor.
Figure 12:
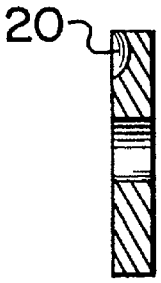
FIG. 12 is a side view of FIG. 11 taken along the lines 12—12 of FIG. 11.
Figure 13:
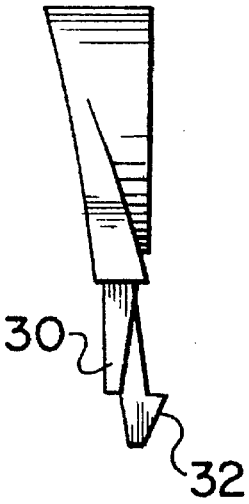
FIG. 13 is a side view of an earmuffs adaptor.
Figure 14:
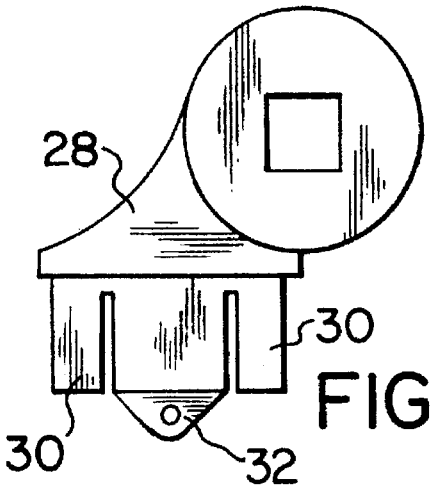
FIG. 14 is a front view of FIG. 13.
Figure 15:
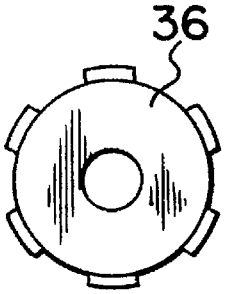
FIG. 15 is a side view of a tension nut of the intermediate adaptor.
Figure 16:
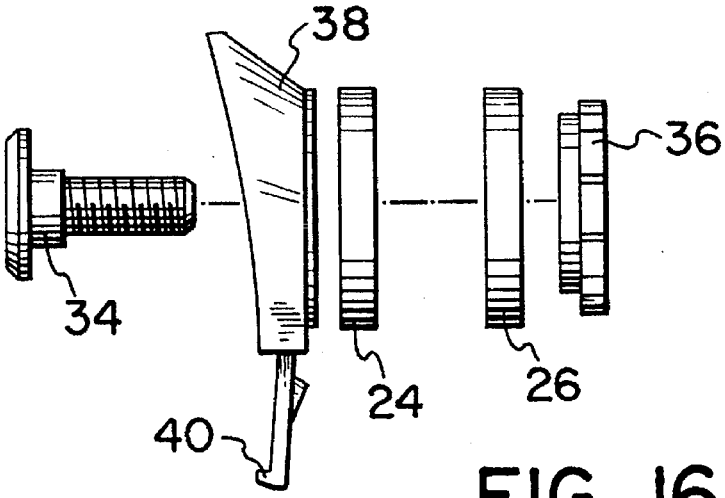
FIG. 16 is disassembled side view showing a second modification of an earmuffs adaptor and intermediate adaptor.
Figure 17:
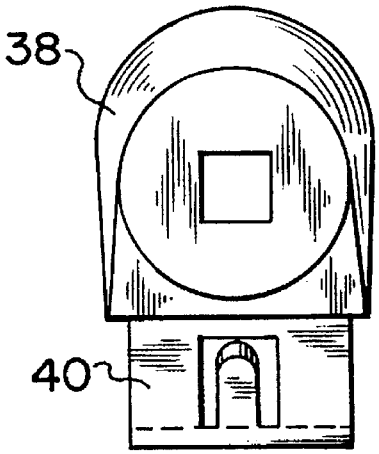
FIG. 17 is a front view of the earmuffs adaptor of FIG. 16.
Figure 18:
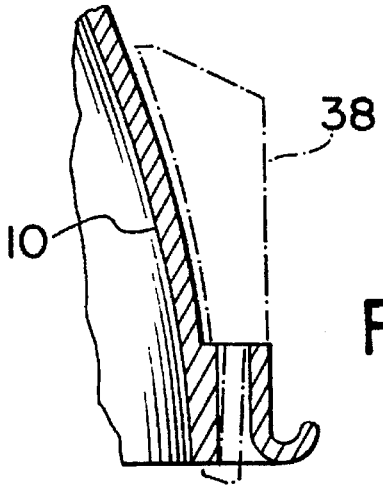
FIG. 18 is a fragment of side cross-sectional view showing prefabricated slot of the helmet with the mounted earmuffs adaptor of FIG. 17.

The complete assembly is very easily attached to the side of the helmet 10 by means of pre-fabricated slot 23 as shown on FIG. 3. FIGS. 16–18 show the second embodiment of the invention, wherein the same carrier 16 by means of an intermediate adaptor 22 is mounted on an adaptor 38. This adaptor is also standard equipment available in the trade and is shown, for example, in the U.S. Pat. No. 4,516,192. As in the first embodiment, carrier 16 is inserted between clamps 24 and 26 of the intermediate adaptor 22 which are in turn placed on the bolt 42 of the adaptor 38. Pressure is applied to the ball of carrier 18 by tightening a tension nut 44 against clamp 26. Adaptor 38 is mounted to the side of helmet 10 by means of leaf 40 and a pre-fabricated slot 23 (see FIG. 18).

FIGS. 19–22 show the third embodiment of the invention where the carrier 16 is mounted on a specially designed adaptor 46 to be attached to helmets not provided with pre-manufactured slots, such as protective helmets used by firefighters (and construction workers). The side view of said adaptor 46 shows that its lower end has a hook-shape configuration corresponding to the configuration of the helmet's brim 15. Socket 20 of the adjustment means is formed within the upper part of adaptor 46. The carrier 16 is inserted in said socket 20 by means of ball 18 and when the proper position of the carrier is achieved, it is locked into position by means of two set screws 48. Another set screw 50 is used to apply pressure between the holder 46 and the brim of helmet 11. Those set screws 48 and 50 are standard hexagon head set screws. As show on FIG. 20, the brim 15 of the helmet 11 is additionally provided with a rubber protector 19.

Figure 23:
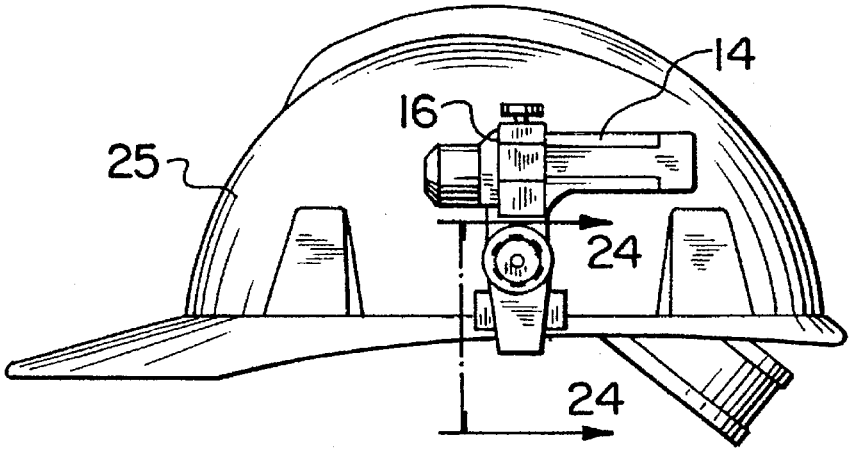
FIG. 23 is a side view of fourth embodiment of the safety helmet with the holder attached to the side.
Figure 24:
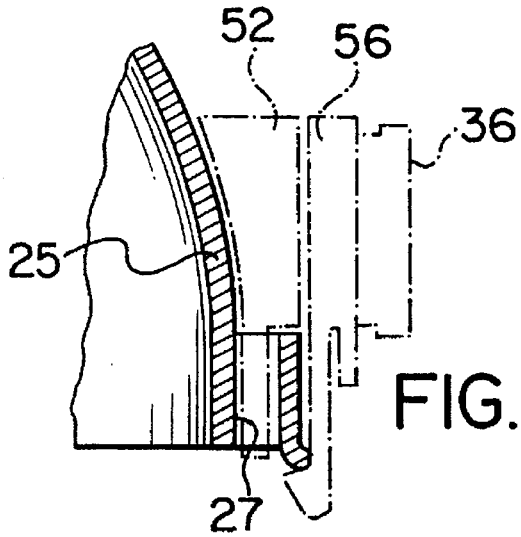
FIG. 24 is a fragment of a side cross-section taken along the lines 24—24 showing the pre-fabricated slot on the helmet and an adaptor mounted in it.
Figure 25:
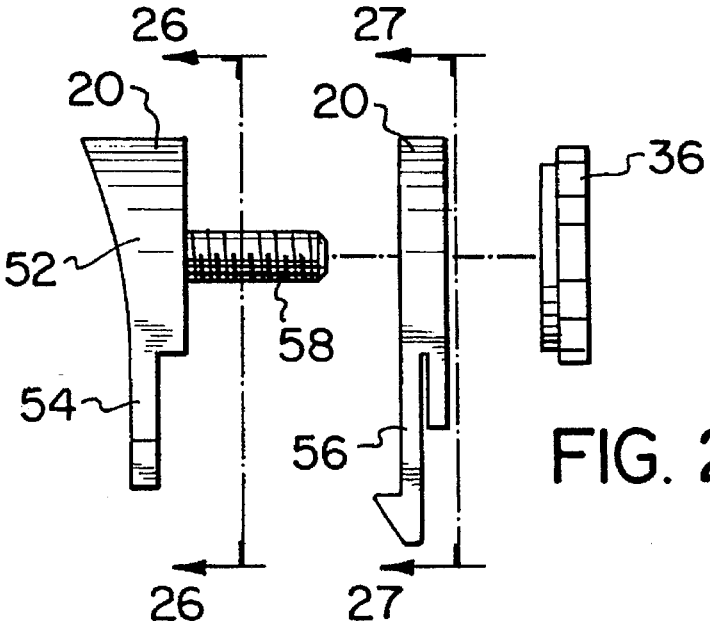
FIG. 25 shows a side view of an adaptor of the fourth embodiment of the present invention in disassembled configuration.
Figure 26:
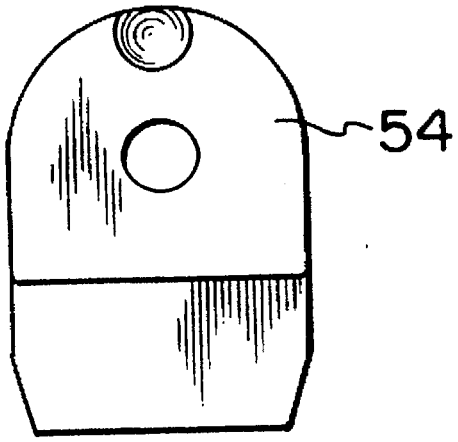
FIG. 26 is a front view of the left half of the adaptor of FIG. 25 taken along the lines 26—26.
Figure 27:
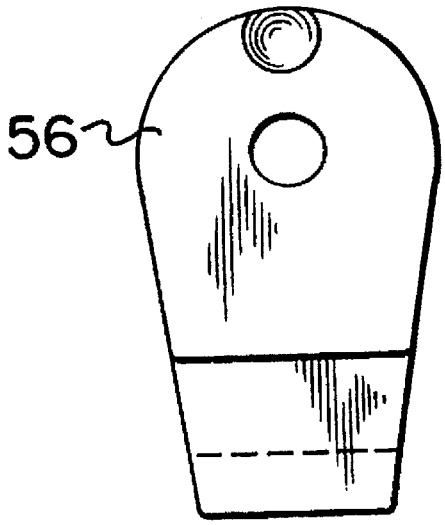
FIG. 27 is a front view of the right half of the adaptor of FIG. 25 taken along the lines 27—27.
Figure 28:
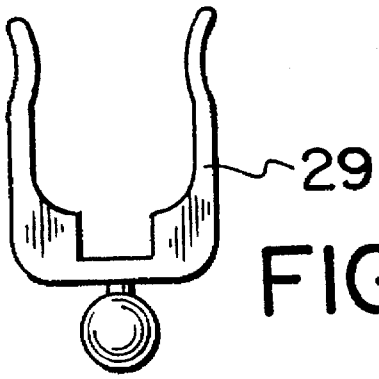
FIG. 28 is a front view of the carrier made according the second embodiment of the present invention.

FIGS. 23–27 show the fourth modification of the invention wherein the carrier 16 is mounted on an adaptor 52. This arrangement is an alternative to the arrangement of FIGS. 2 and 18 in which the adaptors are inserted into the slots of helmet 10 and are locked inside said slots by means of a leaf or lug formed on the lower part of the said adaptors. The arrangement of FIG. 23 is such that the adapter 52 is inserted into the slot 27 of a standard construction helmet 25 and locks outside of the slot. Adaptor 52 comprises two halves 54 and 56. The socket 20 is formed within the upper parts of those halves. The carrier 16 is inserted between halves 54 and 56, wherein half 56 is placed on bolt 58 of half 54. Pressure is applied to the ball 18 of the carrier 16 by tightening the tension nut 60 against half 56. In this arrangement adaptor 52 is inserted into a slot of helmet 25 by means of the leaf of half 54 and is locked to the outside of the slot by means of half 56. FIG. 28 shows another modification of carrier 29 wherein the side walls have a lyre-shaped configuration in cross-section, allowing the insertion of flashlight 14 by the open top. In this modification, the top portion of the carrier 29 is shortened and side walls are bent inwardly, wherein the securing of the flashlight 14 is provided by means of resiliency or clamping force of the inner walls.

This arrangement would be advantageous for those applications where the flashlight is installed and removed from the safety head holder several times per day, and the clamping action of the thumbscrew 17 would not be required to firmly hold the flashlight.

Figure 19:
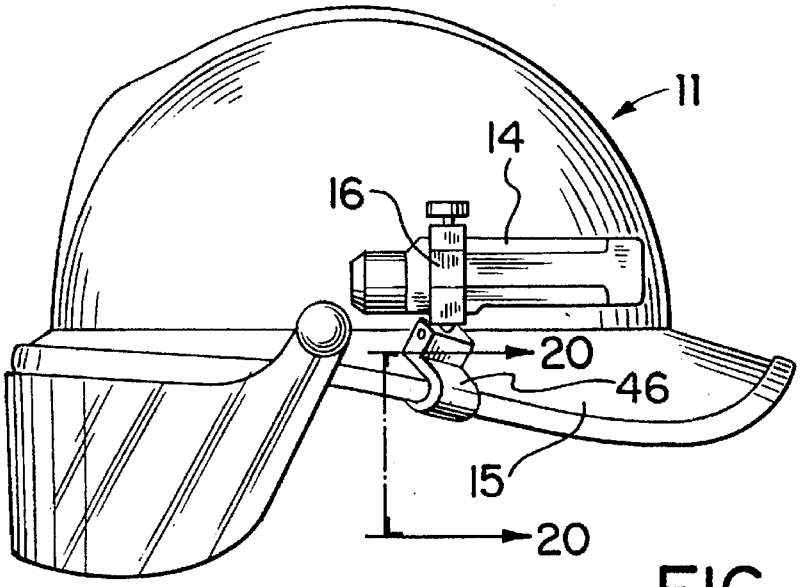
FIG. 19 shows a side view of the third modification of the holder being attached to the side of the firefighter's helmet.
Figure 20:
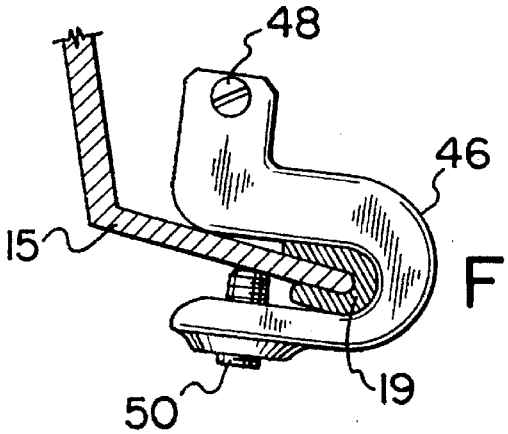
FIG. 20 is a fragment of a side cross-sectional view of the adaptor taken along the lines 20—20 of FIG. 19.
Figure 21:
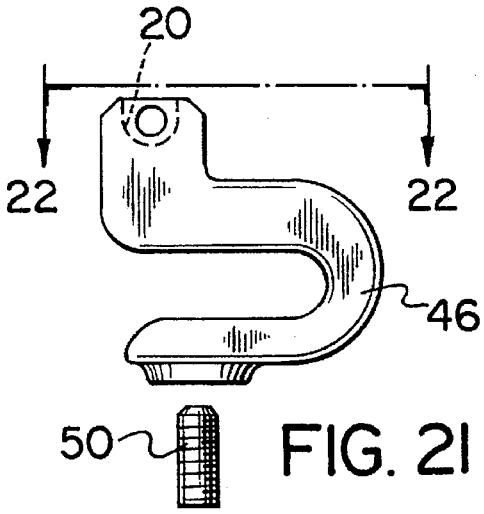
FIG. 21 is a side view of the adaptor of FIG. 20.
Figure 22:
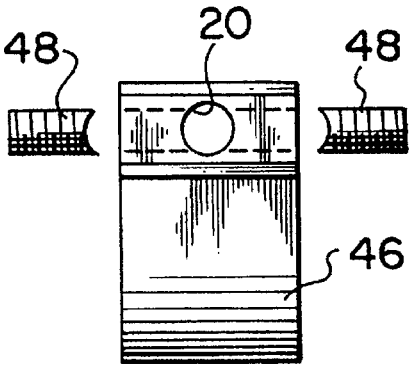
FIG. 22 is a top view of FIG. 21 taken along the lines 22—22.
Figure 29:
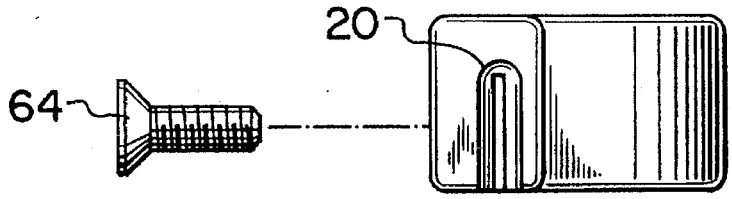
FIG. 29 shows a top view of the fifth modification of the adaptor used for firefighter's helmet.
Figure 30:
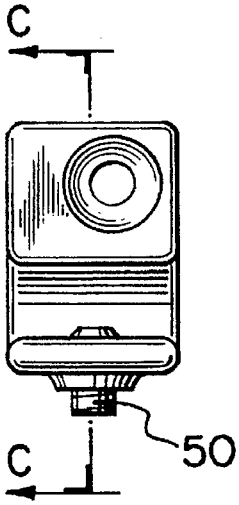
FIG. 30 shows back view of FIG. 29.
Figure 31:
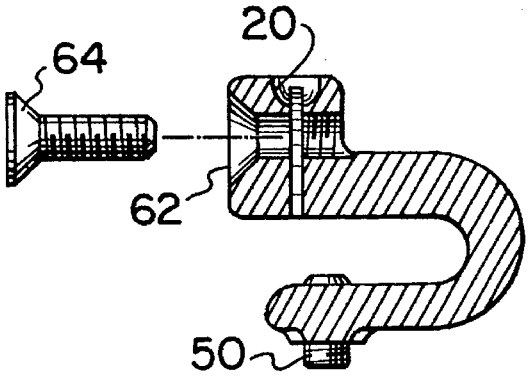
FIG. 31 shows a side cross-sectional view of FIG. 30 taken along the lines CC.
Figure 32:
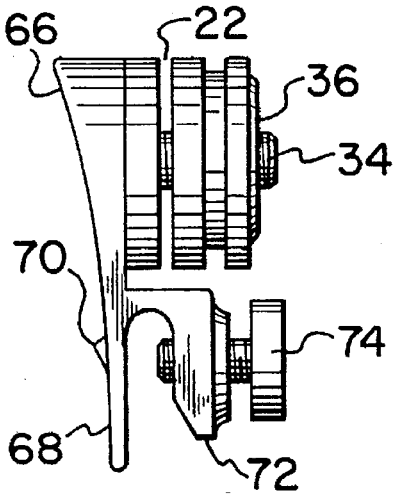
FIG. 32 shows a side view of the sixth modification of the adaptor used with helmets having prefabricated slot.
Figure 33:
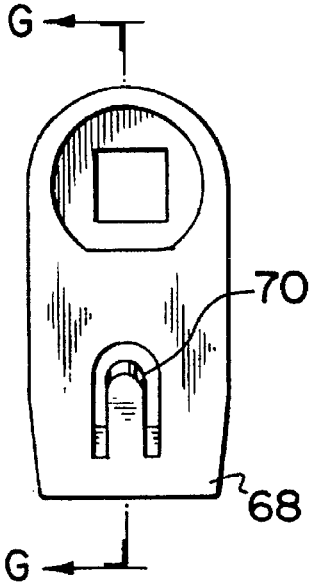
FIG. 33 shows a back view of FIG. 32.
Figure 34:
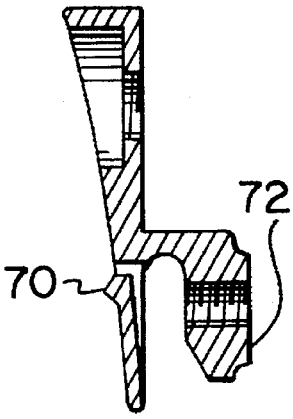
FIG. 34 shows a side cross-sectional view of FIG. 33 taken along the lines GG.

FIGS. 29–31 show the fifth embodiment of the invention, which is similar to the third embodiment of FIGS. 19 and 22 for a firefighter's helmet, wherein a specially designed adaptor 62 is attached to helmets not provided with pre-manufactured slots. In this embodiment, the lower end of adaptor 62 also has a hook-shaped configuration corresponding to the configuration of the helmet's brim. However, a socket 20 has a groove-shaped configuration made in the upper portion of the adaptor 62 allowing a ball 18 of the carrier 16 to be easily inserted by a sliding movement inside of socket 20. A single clamping or set socket screw 64 applies pressure to ball 18 inserted into the adaptor 62. The screw 64 also serves as a stopper to prevent the carrier 16 from sliding out of the adaptor 62. FIGS. 32—34 show the sixth embodiment of the present invention, which is similar to first embodiment of FIG. 5; however, instead of using a standard adaptor 28, this embodiment uses an universal adaptor 66 specially designed for safety helmets provided with pre-fabricated slots on both sides. This adaptor 66 is universal to fit practically any slotted hardhat in the world. The difference with this adaptor is that, unlike other known adaptors which lock to the lower extremity of the slot in the hardhat, the locking operation is provided by means of locking to the outer wall of the slotted section of the hardhat. In this embodiment an intermediate adaptor 22 is secured to the upper portion of adaptor 66 by means of bolt 34 and tension nut 36 of the adaptor 66. The lower part of the adaptor 66 comprises two portions 68 and 72 respectively. First portion of leaf 68 is provided with a resilient tong 70 which slides into the slot of the helmet and applies an additional friction between the adaptor and the slot. Second portion 72 has a threaded tension or locking screw 74, which applies pressure to the outer wall of the slotted section of the hardhat. This arrangement would permit the user to remove the holder from the helmet which more easily by simply loosening the locking screw 74 and sliding the adaptor 66 out of the slot.

Figure 35:
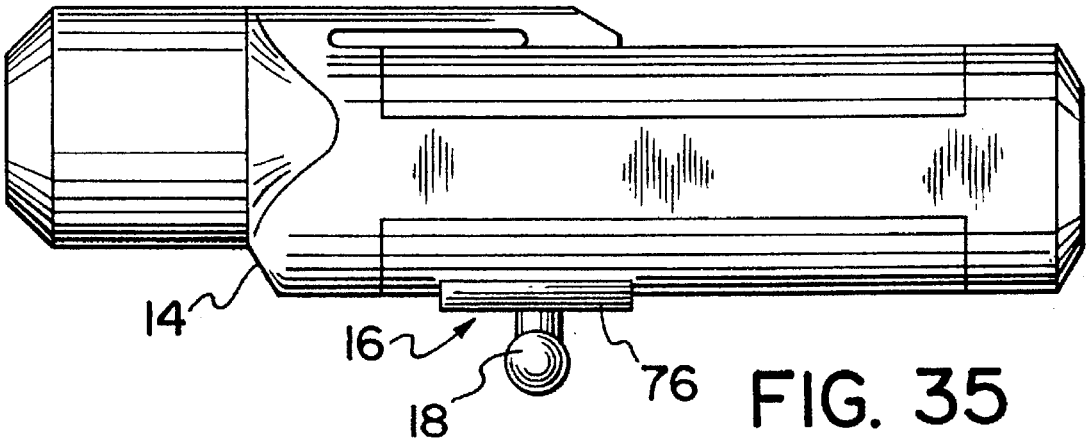
FIG. 35 shows a side view of the seventh modification of the adaptor permanently attached to the body of flashlight.
Figure 36:
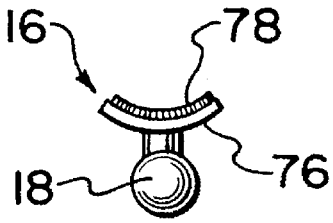
FIG. 36 shows a front view of the adaptor of FIG. 35 without the flashlight.
Figure 37:
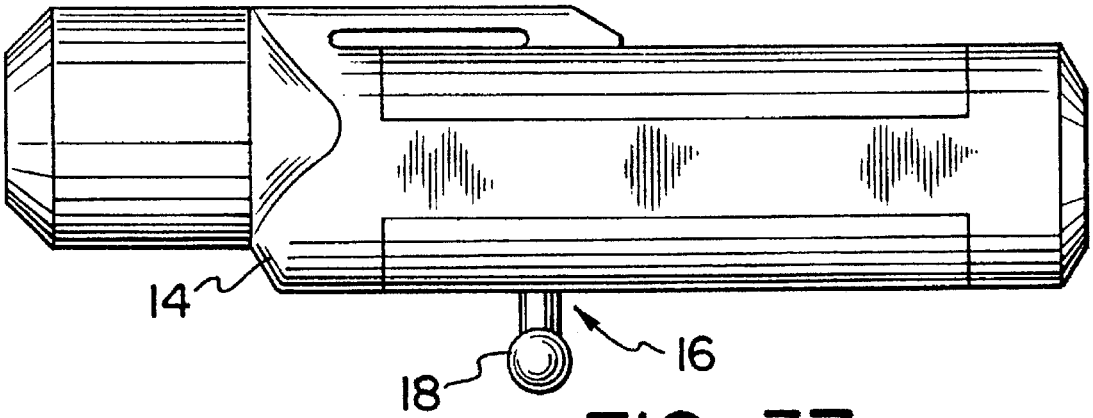
FIG. 37 shows a second modification of the adaptor of FIG. 35 molded into the body of the flashlight.

FIGS. 35–37 show seventh embodiment of the present invention wherein the carrier 16 is integrally connected to the outer wall or casing of the flashlight element 14. Referring to FIG. 34 the carrier 16 has an upper portion 76 of substantially concave or semi-cylindrical configuration, which corresponds to the configuration of the outer wall of flashlight element 14. The carrier 16 is integrally connected to the casing 14 by means of glue or adhesive applied to the surface 76 of portion 78. The carrier 16 could be glued to any existing small flashlight and may be used with any adaptor of the present invention. In second modification of seventh embodiment, carrier 16 is incorporated into the mold of any small flashlight as shown on FIG. 35 to create a one-piece configuration. In this case, flashlight 14 with built in ball 18 may also be inserted into any adaptor of the present invention. This new one-piece arrangement may be used for any flashlight, which, of course, should not be too heavy to be carried on one's head.

One of the main advantages of the present invention is the fact that the carrier can accommodate within its inner walls a standard flashlight of any size including a penlight size flashlight, by means of size adapter 21, or any such other adapter, which can be designed for any flashlight of any dimension.

Another advantage is that the same type of carrier can be used for any design of safety helmets, including those without pre-fabricated slots. Indeed, mounting of the carrier is provided by means of an intermediate adaptor as shown in the first and second embodiments, or by means of specially designed adaptors as shown in the third and fourth embodiments.

Yet another advantage of the present invention is the use of light weight non-conductive material which meets required safety regulations. Another advantage is the full adjustability of the light beam, providing a powerful light where it is needed without the need of a counterweight. Simplicity of method of manufacture allows for easy modification of the configuration of the inner walls of the carrier and its size according to the specification of any future designs of flashlights, thus eliminating the need of a size adaptor 21.

It is also relatively simple to mount on the same adaptor other types of safety equipment, such as earmuffs or faceshield. It is also very secure and is adapted to withstand a heavy abuse in any harmful environment including high impact, acid evaporation under the ground or high temperature in fire hazardous situations.

Since various modifications can be made to my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A flashlight holder for protective helmets or hardhats comprising:

a carrier element having outer walls and inner walls and adapted to accommodate within the inner walls a standard flashlight, wherein said carrier element accommodates said flashlight across the flashlight's width;

an adjustment means connected to said carrier element and provided to adjust said carrier element holding the flashlight under any desirable angle by a protective helmet wearer;

a mounting adaptor means connected to said carrier element through said adjustment means and provided to releasably attach said holder to the protective helmet, wherein said holder is attached directly to a side of the helmet and wherein said mounting adaptor means is adapted to withstand an extensive abuse in a heavy industrial environment.

2. A holder as in claim 1, wherein said adjustment means are located at a lower extremity of said carrier element.

3. A holder as in claim 1, wherein said adjustment means comprises swivel ball-socket arrangement.

4. A holder as in claim 3, wherein the ball of said ball-socket arrangement is an integral part of said carrier element, wherein the socket of said ball-socket arrangement is incorporated within an upper part of said mounting adaptor means, and wherein the ball of said ball-socket arrangement is secured in said socket by a tightening means.

5. A holder as in claim 1, wherein said carrier element is provided with a size adaptor located within the inner walls of said carrier element and wherein said size adaptor is provided to fit a flashlight of smaller size.

6. A holder as in claim 1, wherein said holder is made of a non-conductive material.

7. A holder as in claim 1, wherein said carrier element has a securing means provided to secure the flashlight within said carrier element.

8. A holder as in claim 4, wherein said mounting adaptor means comprises two vertically oriented halves, and wherein the socket of said ball-socket arrangement is incorporated within upper part of said halves; the ball of said ball-socket arrangement is secured in said socket by a tightening means.

9. A holder as in claim 7, wherein said securing means comprise a resiliency of the inner walls of said carrier element providing clamping action towards the flashlight accommodated inside of said carrier.

10. A combination of a protective helmet comprising a helmet and a flashlight holder attached to said helmet, wherein said flashlight holder comprises:

a carrier element having outer walls and inner walls and adapted to accommodate within the inner walls a standard flashlight, wherein said carrier element accommodates said flashlight across the flashlight's width;

an adjustment means connected to said carrier element and provided to adjust said carrier element holding the flashlight under any desirable angle by a protective helmet wearer;

a mounting adaptor means connected to said carrier element through said adjustment means and provided to releasably attach said holder to the protective helmet, wherein said holder is attached directly to a side of the helmet and wherein said mounting adaptor means is adapted to withstand an extensive abuse in a heavy industrial environment.

11. A combination as in claim 10, wherein said adjustment means are located at a lower extremity of said carrier element.

12. A combination as in claim 10, wherein said adjustment means comprises a swivel ball-socket arrangement.

13. A combination as in claim 12, wherein the ball of said ball-socket arrangement is an integral part of said carrier element, wherein the socket of said ball-socket arrangement is incorporated within an upper part of said mounting adaptor means, and wherein the ball of said ball-socket arrangement is secured in said socket by a tightening means.

14. A combination as in claim 10, wherein said carrier element is provided with a size adaptor located within the inner walls of said carrier element and wherein said size adaptor is provided to fit a flashlight of smaller size.

15. A combination as in claim 10, wherein said holder is made of a non-conductive material.

16. A combination as in claim 10, wherein said carrier element has a securing means provided to secure the flashlight within said carrier element.

17. A combination as in claim 13, wherein said mounting adaptor means comprises two vertically oriented halves, and wherein the socket of said ball-socket arrangement is incorporated within upper part of said halves; the ball of said ball-socket arrangement is secured in said socket by a tightening means.

18. A combination as in claim 16, wherein said securing means comprise a resiliency of the inner walls of said carrier element providing clamping action toward the flashlight accommodated inside of said carrier.

19. A combination according to claim 13, wherein said mounting adaptor means comprises an intermediate adaptor comprising two vertically oriented halves, wherein the socket of said ball-socket arrangement is incorporated within upper parts of said halves; and an adaptor connected to said intermediate adaptor and provided to be releasably attached to a pre-fabricated slot made in said helmet.

20. A holder as in claim 4, wherein a lower portion of said mounting adaptor means having a shape corresponding to the configuration of a brim of said helmet, said mounting adaptor means is attached to said brim by a tightening means.

21. A holder as in claim 8, wherein a lower portion of one of said two halves is shaped to be inserted into a pre-fabricated slot of said helmet, and wherein a lower portion of second of said two halves is shaped to lock said mounting adaptor means outside of said slot by said tightening means.

22. Combination of a protective helmet comprising a helmet and a flashlight holder attached to said helmet, wherein said holder comprises;

a carrier element having a configuration defining means to accommodate a flashlight element;

an adjustment means connected to said carrier element and provided to adjust a light of said carrier element under any desirable angle by a protective helmet wearer;

a mounting adaptor means connected to said carrier element through said adjustment means and provided to releasably attach said holder to said protective helmet, wherein said holder is attached directly to a side of said protective helmet and wherein said mounting adaptor means is adapted to withstand an extensive abuse in heavy industrial environment.

23. A combination according to claim 22, wherein said carrier element is connected to an outer wall or casing of said flashlight element.

24. A combination according to claim 23, wherein an upper portion of said carrier element having a shape corresponding to the shape of the outer wall or casing of said flashlight element to facilitate better connection of said carrier to said flashlight element.

25. A combination according to claim 23, wherein said carrier element comprises a unitary or one piece configuration with the casing of said flashlight element.

26. A combination as in claim 22, wherein said adjustment means are located at a lower extremity of said carrier element.

27. A combination as in claim 22, wherein said adjustment means comprises a swivel ball-socket arrangement.

28. A combination as in claim 22, wherein said holder is made of a non-conductive material.

29. A holder according to claim 20, wherein said socket has a groove-shape configuration to facilitate sliding of said ball into said socket.

30. A combination according to claim 19, wherein a lower portion of said adaptor comprises two parts and wherein one of said parts is shaped to releasably slide into the slot of said helmet and a second part having a shape allowing to securely lock said holder to an outer wall of said helmet by a tightening means.

* * * * *